US010720008B2

(12) United States Patent
Tsai et al.

(10) Patent No.: US 10,720,008 B2
(45) Date of Patent: Jul. 21, 2020

(54) STRUCTURAL AND LIGHTING APPARATUS FOR A GAME MACHINE

(71) Applicant: FEILOLI ELECTRONIC CO., LTD., Hemei Town, Changhua (TW)

(72) Inventors: Chi-Ming Tsai, Hemei Town (TW); I-Chiang Yang, Hemei Town (TW)

(73) Assignee: FEILOLI ELECTRONIC CO., LTD., Hemei Town (TW)

( * ) Notice: Subject to any disclaimer, the term of this patent is extended or adjusted under 35 U.S.C. 154(b) by 269 days.

(21) Appl. No.: 15/968,920

(22) Filed: May 2, 2018

(65) Prior Publication Data

US 2019/0340870 A1 Nov. 7, 2019

(51) Int. Cl.
*F21V 7/04* (2006.01)
*G07F 17/32* (2006.01)

(52) U.S. Cl.
CPC ..... *G07F 17/3216* (2013.01)

(58) Field of Classification Search
USPC ..... 362/604
See application file for complete search history.

(56) References Cited

U.S. PATENT DOCUMENTS 5,695,261 A * 12/1997 Slesinger ..... A47F 11/10 312/223.6
8,220,953 B1 * 7/2012 Moore ..... F21S 8/04 362/217.01
9,279,544 B1 * 3/2016 Dankelmann ..... F21K 9/90
2004/0001335 A1 * 1/2004 Wu ..... G07F 17/32 362/127
2007/0230212 A1 * 10/2007 Misof ..... A47B 97/00 362/600
2007/0287527 A1 * 12/2007 Tanabe ..... G07F 17/32 463/20
2011/0116007 A1 * 5/2011 Park ..... G02F 1/133606 349/61
2017/0001100 A1 * 1/2017 Stellenberg ..... G07F 17/3211
2019/0051225 A1 * 2/2019 Sylvester ..... F21V 11/16

* cited by examiner

*Primary Examiner* — Rodney E Fuller
(74) *Attorney, Agent, or Firm* — Alan D. Kamrath; Mayer & Williams PC

(57) ABSTRACT

A game machine is provided with a structural and lighting apparatus. The structural and lighting apparatus includes a plank, a bar and fins. The bar includes two strips extending on and along a front face of the plank. Each of the strips provides a space with the plank. The bar is located between two panels of two lockers of the game machine so that each of the spaces receives an edge of a corresponding one of the panels. The fins extend on and along a rear face of the plank, thereby providing at least one partition-containing groove for receiving a partition between two lockers and at least one light-containing groove for receiving at least one LED string in the corresponding locker.

5 Claims, 7 Drawing Sheets

STRUCTURAL AND LIGHTING APPARATUS FOR A GAME MACHINE

BACKGROUND OF INVENTION

1. Field of Invention

The present invention relates to game machines and, more particularly, to structural and lighting apparatuses for lockers of game machines.

2. Related Prior Art

To attract customers and increase entertaining effects, a game machine such as a crane machine is equipped with LED strings. The LED strings are provided on an external side of the game machine. The LED cast light onto the game machine, attempting to attract customers.

A type of game machine includes lockers for containing and displaying prizes. To render the prizes clearly visible, each of the lockers is equipped with a fluorescent tube. However, each of the fluorescent tubes occupies some space in the corresponding locker. Moreover, the fluorescent tubes could easily be damaged by the prizes. In addition, some of the lockers are too small for commercially available fluorescent tubes.

The present invention is therefore intended to obviate or at least alleviate the problems encountered in prior art.

SUMMARY OF INVENTION

It is the primary objective of the present invention to provide lockers of a game machine with a structural and lighting apparatus.

To achieve the foregoing objective, the game machine is provided with a structural and lighting apparatus. The structural and lighting apparatus includes a plank, a bar and fins. The bar includes two strips extending on and along a front face of the plank. Each of the strips provides a space with the plank. The bar is located between two panels of two lockers of the game machine so that each of the spaces receives an edge of a corresponding one of the panels. The fins extend on and along a rear face of the plank, thereby providing at least one partition-containing groove for receiving a partition between two lockers and at least one light-containing groove for receiving at least one LED string in the corresponding locker.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
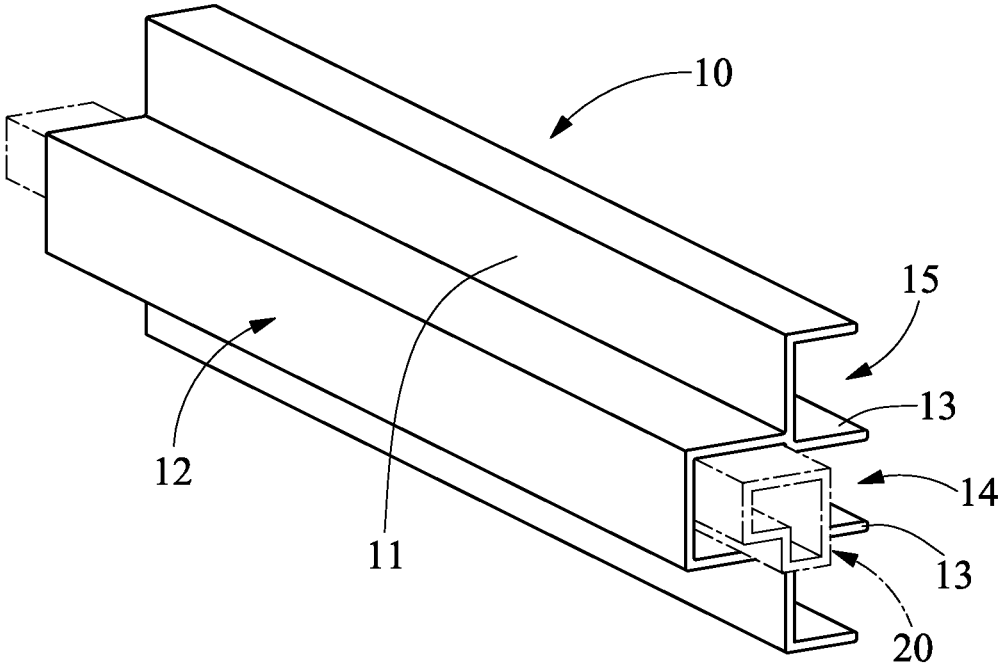
FIG. 1 is a perspective view of a structural and lighting apparatus according to the preferred embodiment of the present invention.
Figure 2:
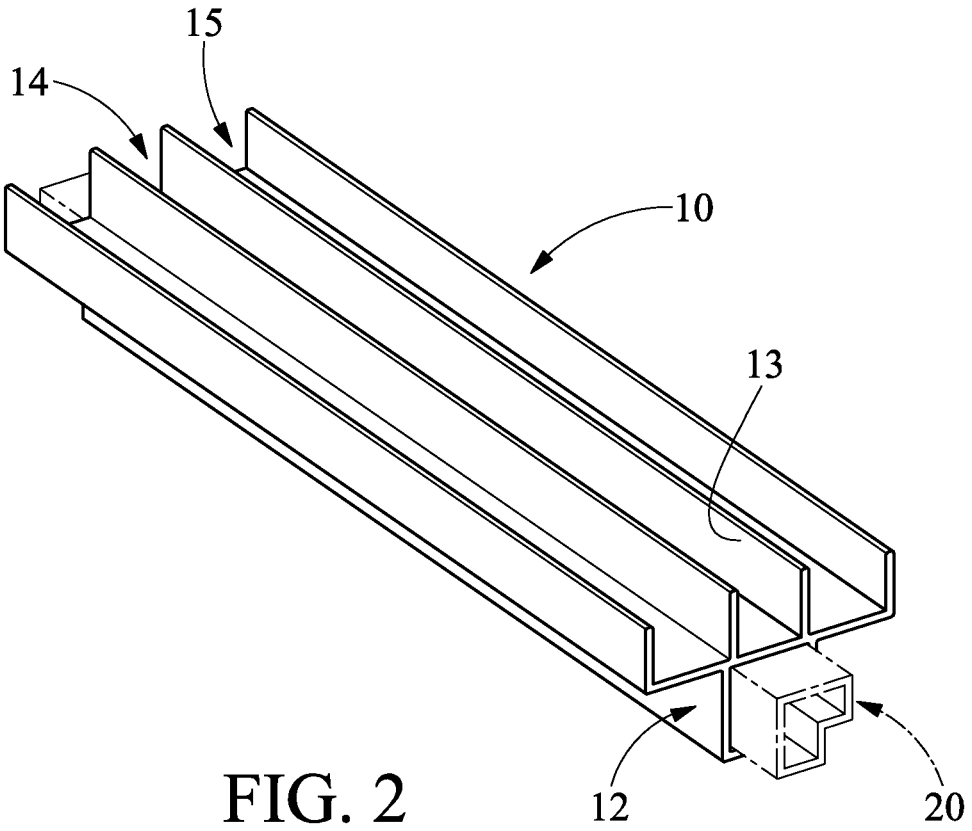
FIG. 2 is another perspective view of the structural and lighting apparatus shown in FIG. 1.
Figure 3:
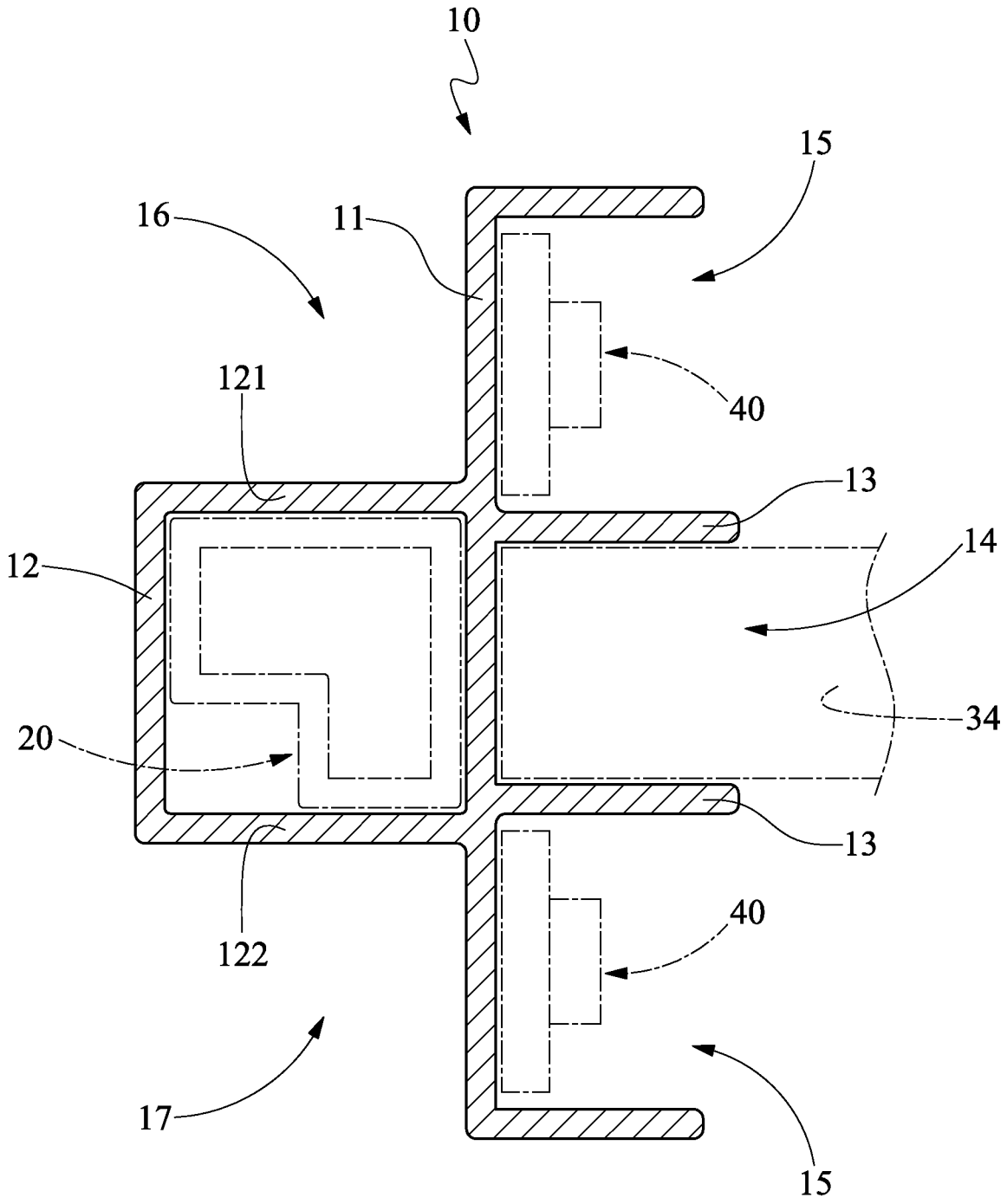
FIG. 3 is a cross-sectional view of the structural and lighting apparatus shown in FIG. 1.

Referring to FIGS. 1 through 6, a game machine 30 includes several lockers 31 and structural and lighting apparatuses 10 according to the preferred embodiment of the present invention. Each of the lighting apparatuses 10 includes a plank 11, a bar 12 extending on and along a front face of the plank 11, and several fins 13 extending on and along a rear face of the plank 11. The following description referring to FIG. 1 through will be given to only one of the structural and lighting apparatuses 10 for briefness. The plank 11 is located between two adjacent ones of the lockers 31 of the game machine 30 in use.

The bar 12 is a hollow element that includes two strips 121 and 122 extending on and along the front face of the plank 11 and another strip (not numbered) extending between the strips 121 and 122. A first space 16 is defined by the strip 121 and the front face of the plank 11. A second space 17 is defined by the strip 122 and the front face of the plank 11. The bar 12 is used as a portion of a frame around a panel of a corresponding one of the lockers 31. Each of the first and second spaces 16 and 17 receives an edge of the panel of a corresponding one of the lockers 31.

The structural and lighting apparatus 10 further includes a coupler 20. The coupler 20 is formed with a middle section and two ends. The middle section of the coupler 20 is inserted in the bar 12. The ends of the coupler 20 extend from the bar 12. Each of the ends of the coupler 20 can be inserted in the bar 12 of another structural and lighting apparatus. Thus, three structural and lighting apparatuses 10 are interconnected, and three lockers 31 are interconnected.

Alternatively, one of the ends of the coupler 20 can be inserted in the bar 12 of another structural and lighting apparatus while of the other end of the coupler 20 can be inserted in an aluminum extrusion 32 of the game machine 30.

Figure 5:
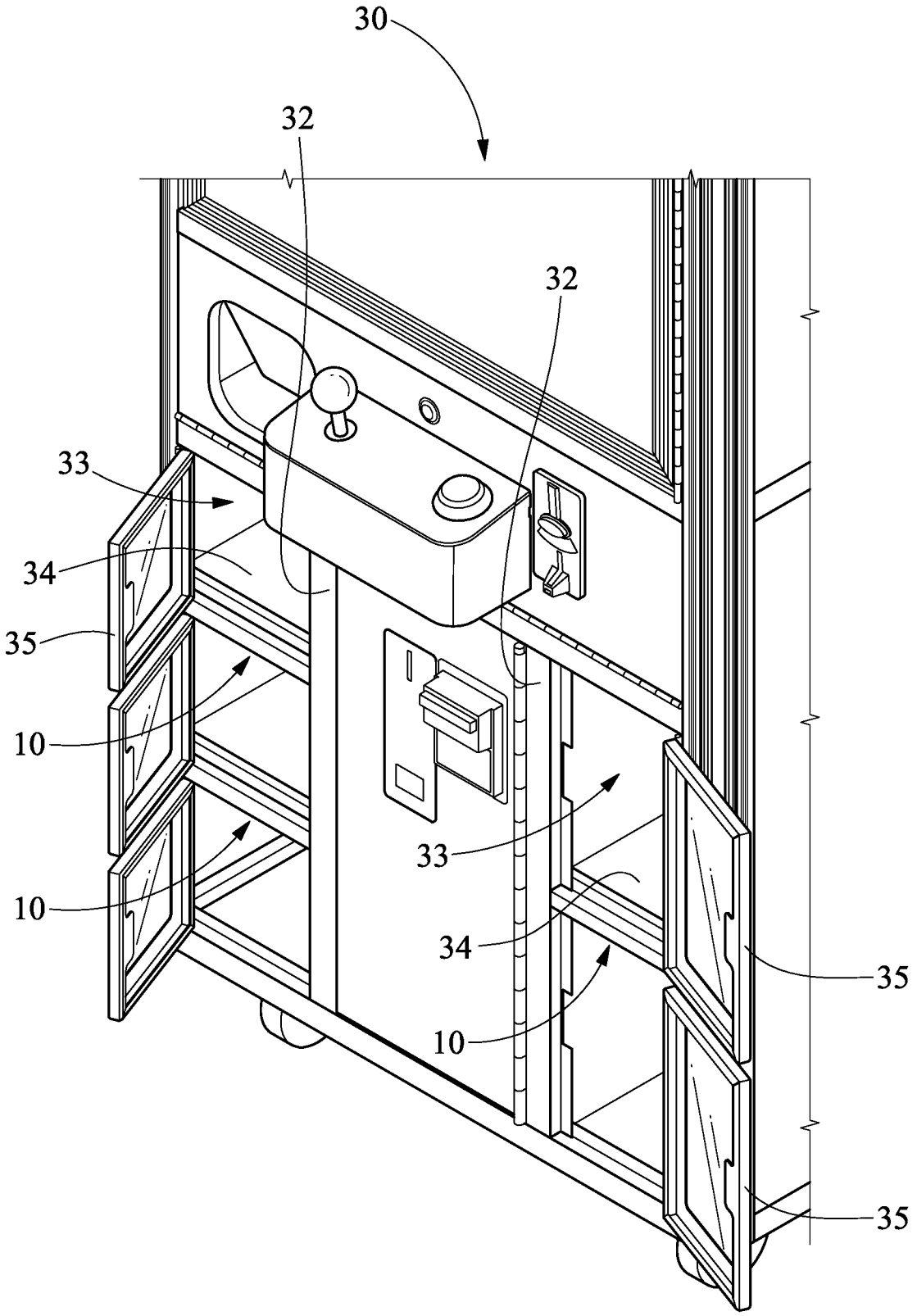
FIG. 5 is an enlarged partial perspective view of the game machine shown in FIG. 4.

Preferably, the structural and lighting apparatus 10 includes four fins 13 to provide a partition-containing groove 14 between two light-containing grooves 15. The partition-containing groove 14 is used to receive an edge of a partition 34 of the corresponding locker 31 (FIG. 5). Each of the light-containing grooves 15 is used to receive an LED string 40. However, there can be only one light-containing groove 15, or the light-containing grooves 15 can be located on a same side of the partition-containing groove 14, or there can be two light-containing grooves 15 on a side of the partition-containing groove 14 and another light-containing groove 15 on another side of the partition-containing groove 14.

Figure 4:
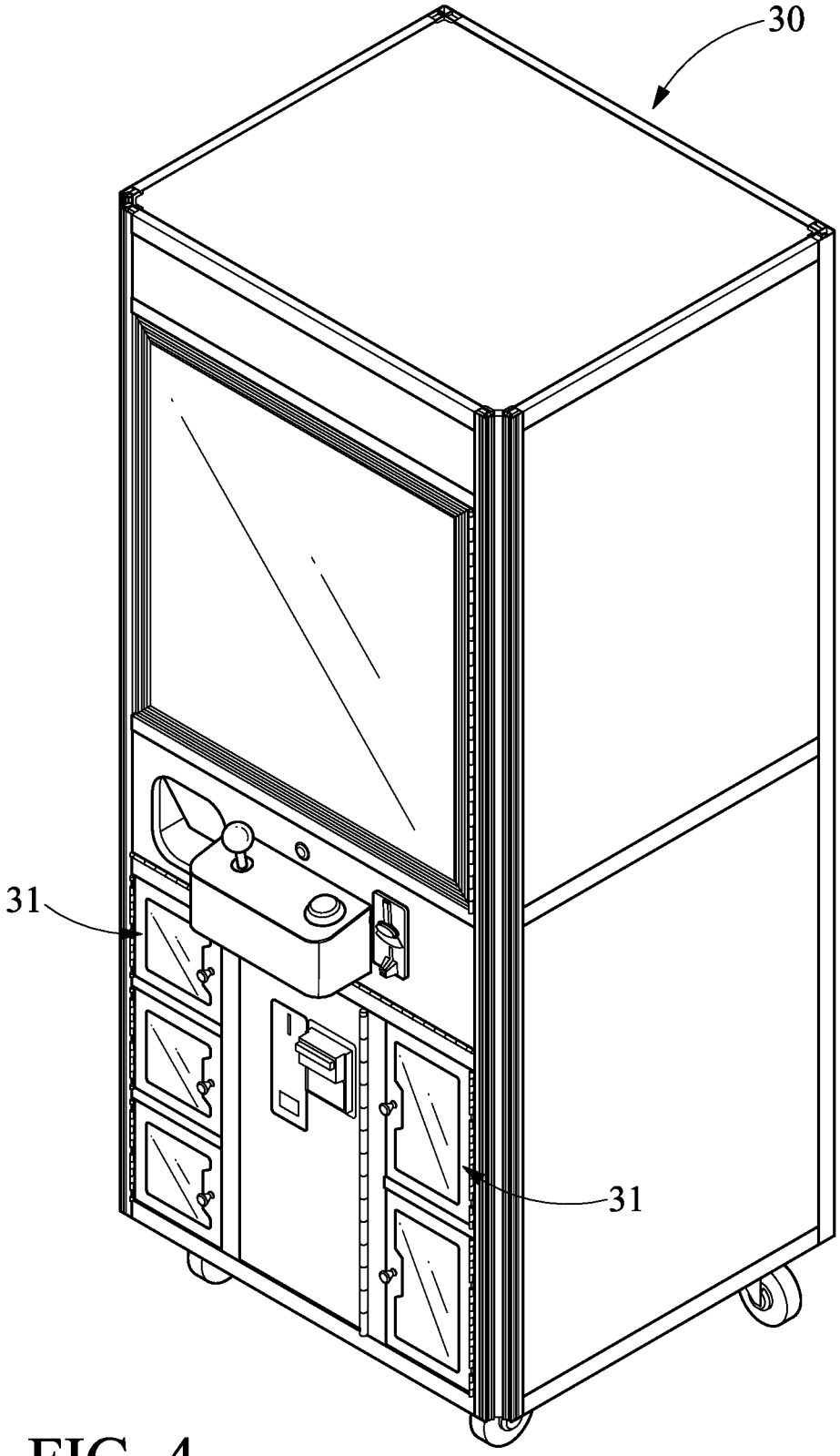
FIG. 4 is a perspective view of a game machine equipped with a plurality of structural and lighting apparatuses as the one shown in FIG. 1.
Figure 6:
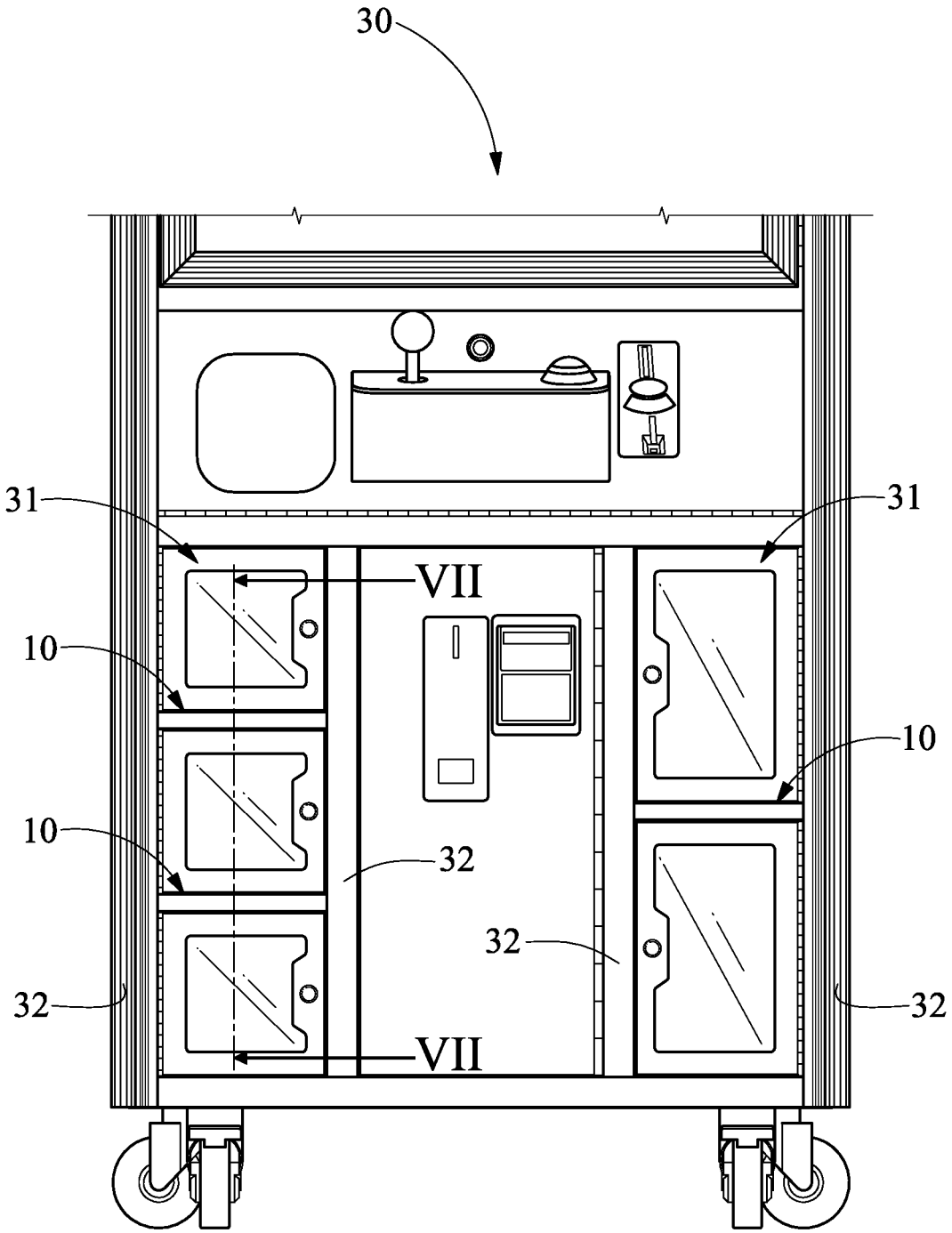
FIG. 6 is an enlarged partial front view of the game machine shown in FIG. 4.

Referring to FIGS. 4 through 6, a proper number of structural and lighting apparatus 10 are used in the game machine 30. The structural and lighting apparatuses 10 are connected to aluminum extrusions 32 and 32' of the lockers 31 of the game machine 30 by the couplers 20.

Figure 7:
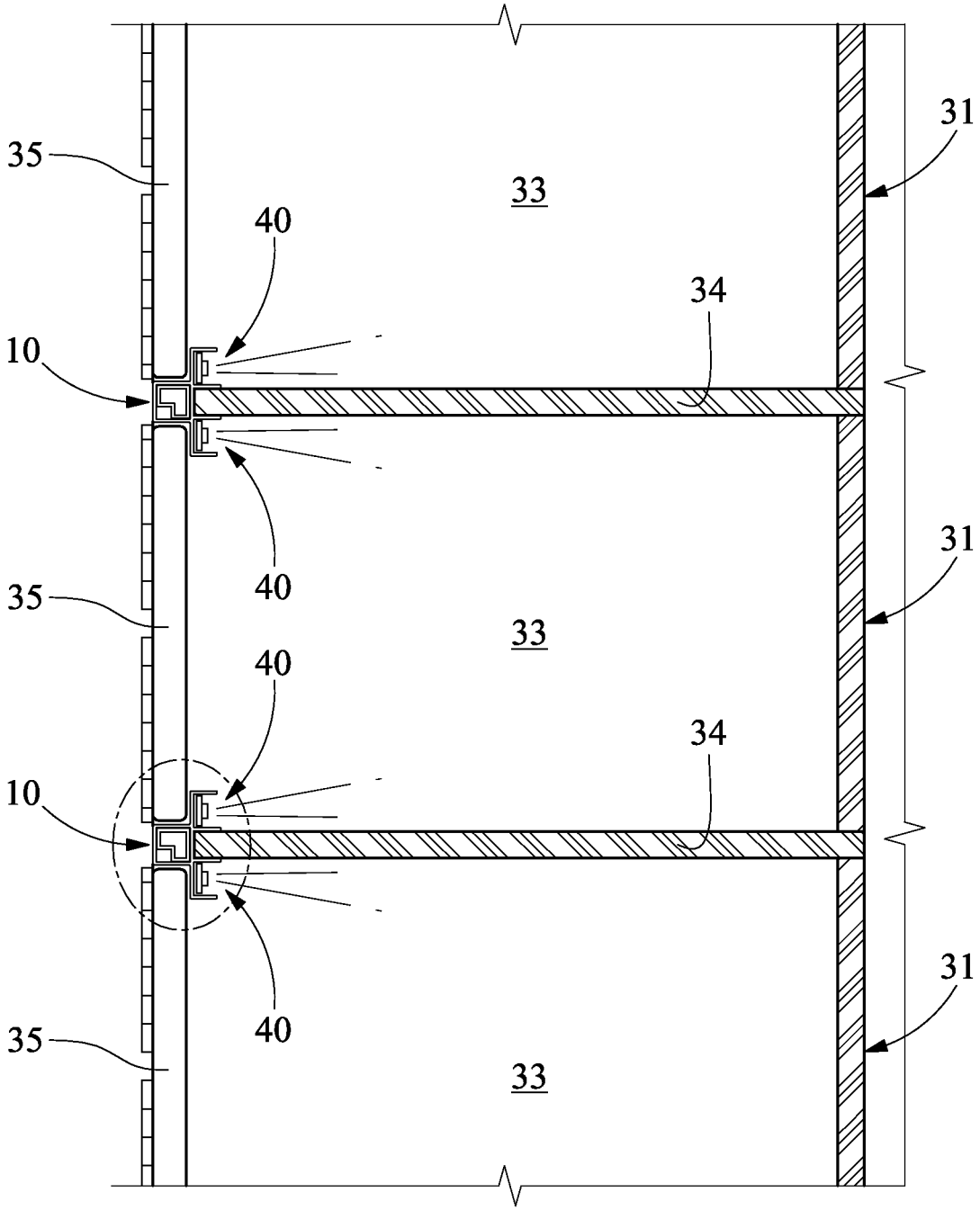
FIG. 7 is an enlarged partial cross-sectional view of the game machine shown in FIG. 4.
Figure 8:
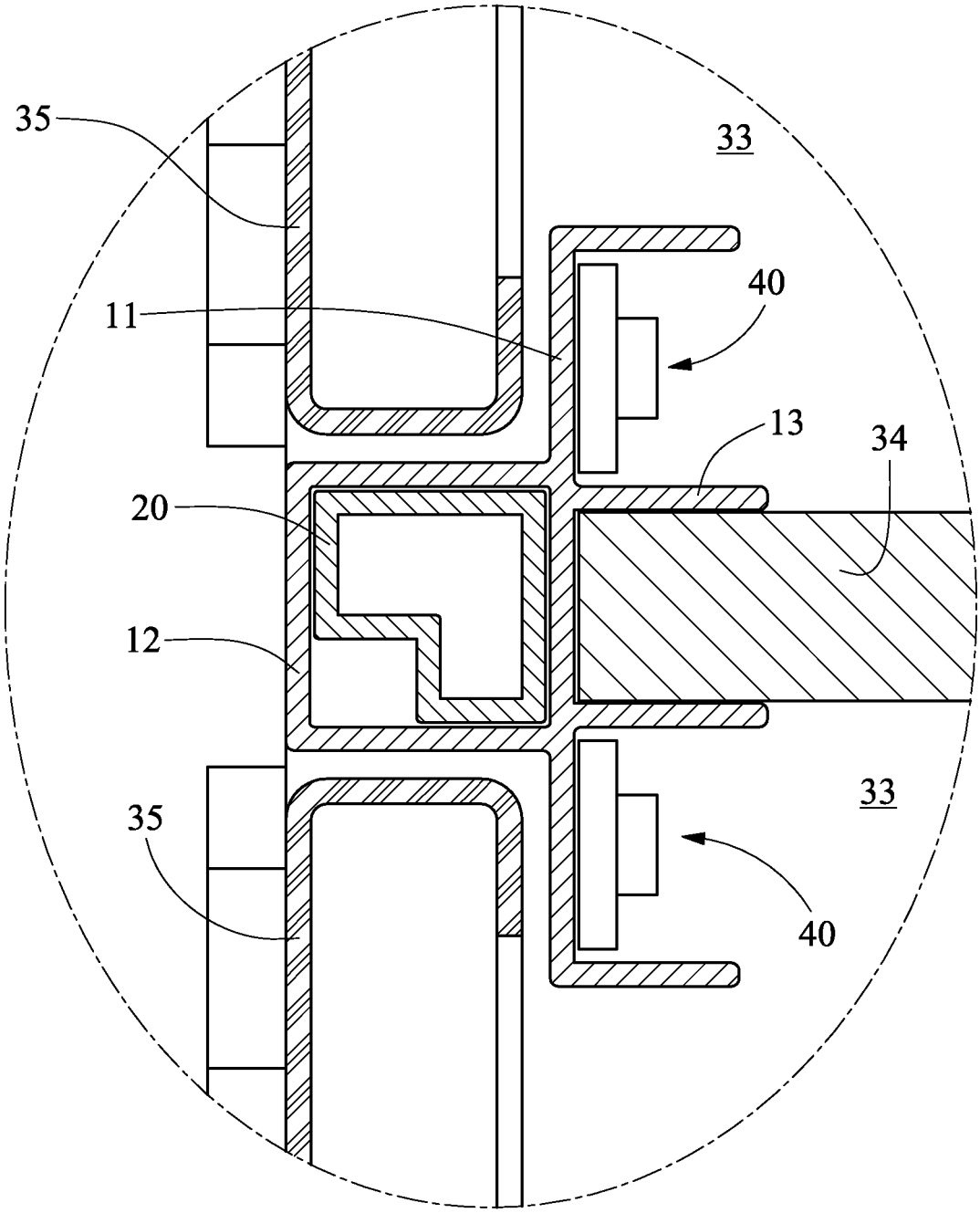
FIG. 8 is an enlarged partial cross-sectional view of the game machine shown in FIG. 7.

Referring to FIGS. 6 to 8, each of the structural and lighting apparatuses 10 is located between two adjacent ones of the lockers 31. The partition-containing groove 14 is located in an interior 33 of a corresponding one of the lockers 31. The light-containing grooves 15 are located in the interior 33 of a corresponding one of the lockers 31. The partition-containing groove 14 receives the edge of the partition 34 located between the lockers 31. The LED string 40 inserted in one of the light-containing grooves 15 casts light in the interior 33 of one of the lockers 31, and the LED string 40 inserted in the other light-containing groove 15 casts light in the interior 33 of the other locker 31. The bar 12 is located between two panels 35 of the lockers 31. Each of the panels 35 is entirely or partially transparent or translucent to render the interior 33 of the corresponding locker 31 visible. Each of the panels 35 can be opened or not. The first space 16 receives a lower edge of the panel 35 of the upper locker 31 and the second space 17 receives an upper edge of the panel 35 of the lower locker 31.

As shown, the structural and lighting apparatus 10 is located between the upper and lower lockers 31. However, the structural and lighting apparatus 10 is located between left and right lockers 31.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A structural and lighting apparatus for a game machine, the structural and lighting apparatus comprising:

a plank (11);

a bar (12) comprising two strips (121, 122) extending on and along a front face of the plank (11), wherein each of the strips (121, 122) provides a space (16, 17) with the plank (11), wherein the bar (12) is located between two panels (35) of two lockers (31) of the game machine (30) so that each of the spaces (16, 17) receives an edge of a corresponding one of the panels (35); and fins (13) extending on and along a rear face of the plank (11), thereby providing at least one partition-containing groove (14) for receiving a partition (34) between two lockers (31) and at least one light-containing groove (15) for receiving at least one LED string (40) in the corresponding locker (31).

2. The structural and lighting apparatus according to claim 1, further comprising a coupler (20) formed with a middle section inserted in the bar (12) and two ends extending from the bar (12), wherein each of the ends of the coupler (20) is inserted in the bar (12) of another structural and lighting apparatus.

3. The structural and lighting apparatus according to claim 2, wherein the structural and lighting apparatus is located between upper and lower lockers (31).

4. The structural and lighting apparatus according to claim 2, wherein the structural and lighting apparatus is located between left and right lockers (31).

5. The structural and lighting apparatus according to claim 1, further comprising a coupler (20) formed with a middle section inserted in the bar (12) and two ends extending from the bar (12), wherein one of the ends of the coupler (20) is inserted in the bar (12) of another structural and lighting apparatus while the remaining one of the ends of the coupler (20) is inserted in an aluminum extrusion (32) of the game machine (30).

* * * * *